United States Patent [19]

Mitsumori et al.

[11] 4,445,614

[45] May 1, 1984

[54] PACKAGING BOX WITH PALLET

[75] Inventors: Mitsugi Mitsumori; Hiroaki Hosaka; Hiroshi Sato; Kouichi Kondou, all of Kanagawa, Japan

[73] Assignee: Mitsubishi Denki Kabushiki Kaisha, Kanagawa, Japan

[21] Appl. No.: 299,260

[22] Filed: Sep. 3, 1981

[30] Foreign Application Priority Data

Oct. 14, 1980 [JP] Japan ..... 55-143328

[51] Int. Cl.[3] ..... B65D 19/00

[52] U.S. Cl. ..... 206/599; 206/597; 206/600; 108/53.1; 108/56.1; 108/56.3

[58] Field of Search ..... 206/599, 597, 600; 220/4 F, 416; 217/43 A; 108/53.1, 53.3, 53.5, 56.1, 56.3

[56] References Cited

U.S. PATENT DOCUMENTS

| | | | |
|---|---|---|---|
| 2,716,532 | 8/1955 | Wysong, Jr. et al. | 108/56.3 |
| 2,894,671 | 7/1959 | Nicholls | 206/599 |
| 2,951,669 | 9/1960 | Davidson | 108/56.1 |
| 3,092,046 | 6/1963 | Davidson | 108/56.1 |
| 3,470,832 | 10/1969 | Heffernan | 108/56.3 |
| 3,692,204 | 9/1972 | Proui et al. | 220/4 F |
| 3,797,727 | 3/1974 | Downing et al. | 217/43 A |
| 4,119,205 | 10/1978 | Delany | 206/200 |
| 4,226,192 | 10/1980 | Myers | 108/53.3 |

FOREIGN PATENT DOCUMENTS

| | | | |
|---|---|---|---|
| 2319051 | 4/1973 | Fed. Rep. of Germany | 108/56.3 |
| 2224137 | 11/1973 | Fed. Rep. of Germany | 108/56.1 |
| 2457811 | 1/1981 | France | 206/599 |

*Primary Examiner*—Joseph Man-Fu Moy
*Attorney, Agent, or Firm*—Sughrue, Mion, Zinn, Macpeak and Seas

[57] ABSTRACT

A pallet is made of a substantially rectangular corrugated fiberboard, so that it has a loading surface region, two end cleats extended from two edges of the loading surface region which are in parallel with the longitudinal axis of the corrugated fiberboard, and at least one V-shaped supporting beam formed at each end of the lower surface of the loading surface region. A bottomless corrugated fiberboard container is placed on the pallet in such a manner that the lower end portion of the container is between the end cleats. The lower end portion of the container is bonded to the end cleats, or is detachably secured to the end cleat, so as to form a packaging box wherein a separable pallet forms the bottom of the box.

5 Claims, 11 Drawing Figures

PACKAGING BOX WITH PALLET

BACKGROUND OF THE INVENTION

This invention relates to a packaging box with a pallet which is made of paper material such as reinforced corrugated fiberboard.

A pallet is often used when a fork lift truck moves articles. The pallet is mainly made of wood, iron or resin. Because of the materials used, it takes a number of manufacturing steps to manufacture the pallet, and the manufactured pallet is relatively costly and heavy. It is also rather difficult to handle the heavy pallet.

One example of the pallet is one made of reinforced corrugated fiberboard. In conventional pallets made of reinforced corrugated fiberboard (hereinafter referred to as "a corrugated pallet", when applicable), three supporting beams are, in general, provided at equal intervals on the lower surface of the loading surface. Each of the supporting beams (hereinafter referred to merely as "beams", when applicable) is formed by laminating a plurality of stripshaped corrugated fiberboard pieces each about 100 mm in width to a desired height (usually 50 to 150 mm). The beams thus formed are bonded to the lower surface of the loading surface. Furthermore, a sheet of corrugated fiberboard is bonded to the lower surfaces of the beams thus bonded to form a double faced pallet. The double-faced pallet is extensively employed, but is disadvantageous in that the number of manufacturing steps is relatively large, a lot of material is required to manufacture the pallet, and accordingly the manufacturing cost is not acceptable.

In view of the foregoing, this invention will provide a corrugated pallet which is made of a sheet of substantially rectangular corrugated fiberboard, having a loading surface and V-shaped beams on the lower surface of the loading surface. A packaging box with such a pallet is obtained by combining the pallet with a bottomless corrugated fiberboard container, obtained by removing a bottom from a conventional corrugated fiberboard container.

First, the pallet will be described with reference to FIGS. 1 and 2. FIG. 1 is an unfolding diagram of a pallet, showing a sheet of a rectangular corrugated fiberboard on which folding lines are formed. FIG. 2 is a perspective view of the pallet which is formed by folding the corrugated fiberboard shown in FIG. 1.

In FIGS. 1 and 2, reference character 1 designates the aforementioned sheet of corrugated fiberboard; 1*a*, a loading surface region; 2, folding lines; and 3, V-shaped beams. In FIG. 1, reference character a designates one edge of the loading surface region 1*a*; b, sides forming each triangular beam 3; e, an intermediate spacing region adapted to space adjacent triangular beams 3 from each other when the pallet is formed; and d, both end regions which are abutted against each other to form a further intermediate spacing region.

The corrugated fiberboard 1 is folded along the folding lines 2 on both sides of the loading surface region, so that the beams 3 are formed at equal intervals on the lower surface of the loading surface region 1*a*. Under this condition, the two end regions are bonded to the lower surface of the loading surface region 1*a* with a strong adhesive, and the intermediate spacing region c is also bonded to the lower surface. Thus, the desired pallet has been formed.

In the above-described example of the pallet, the folding lines 2 are formed on the corrugated fiberboard so that the V-shaped beams are provided at three positions on the loading surface region 1*a* - before folding, two beams are on one side of the loading surface region 1*a* and one beam on the other side. When the pallete is formed by folding the corrugated fiberboard along the folding lines, two beams are at either end of the loading surface region and one beam is at the center. However, the number of beams 3 may be increased according to the size of the loading surface region 1*a*. That is, all that is necessary is to form the folding lines 2 so that at least one beam 3 is formed at each end of the lower surface of the loading surface region 1*a*.

As described above, the pallet can be readily formed according to the method in which the folding lines are formed on a sheet of corrugated fiberboard cut as required, the corrugated fiberboard is folded along the folding lines, and the joining portions are bonded to the lower surface of the loading surface region. As shown in FIG. 2, the upper surface of the pallet thus formed is flat. Therefore, even if small articles are loaded on the pallet, they will slip off because of vibration or inclination, and the loading efficiency and accordingly the transportation efficiency are decreased. It is therefore common to place such articles in a corrugated fiberboard box, and then the box is loaded on the pallet.

In view of the foregoing, it is an object of this invention to provide a novel packaging box using a corrugated pallet.

SUMMARY OF THE INVENTION

In the packaging box with the pallet according to this invention, two end cleats are extended from two opposite edges of the loading surface region which are in parallel with the longitudinal axis of the substantially rectangular corrugated fiberboard, and a bottomless corrugated fiberboard container of A-type, B-type or C-type is placed on the loading surface of the pallet in such a manner that the lower end portion of the container is between the end cleats. The end cleats are bonded to the lower end portion of the container or are secured to the lower end portion with locking pieces. Thus, the packaging box with the pallet according to the invention is of a type in which the container and the pallet can be separated from each other, if necessary. The packaging box with the pallet of the invention can be freely moved to a desired place by a fork lift truck after articles have been placed in the container. Thus, the packaging box with the pallet according to the invention is suitable for storing or transporting articles.

BRIEF DESCRIPTION OF THE DRAWINGS

The foregoing objects and other objects as well as the characteristic features of the invention will become more apparent from the following detailed description when read in conjunction with the accompanying drawings, in which:

FIG. 3 is an unfolding diagram showing a pallet in the first example, and FIG. 4 is a perspective view of the packaging box with the pallet;

FIG. 5 shows how to secure a container to a pallet in the second example, and FIG. 6 shows the container secured to the pallet;

FIG. 7 is an unfolding diagram showing a pallet in the third example, FIG. 8 shows how to secure a container to the pallet in the third example, and FIG. 9 shows the container secured to the pallet; FIG. 10 is an unfolding diagram showing the improved pallet, and FIG. 11 is a perspective view showing a part of the improved pallet.

DESCRIPTION OF THE PREFERRED EMBODIMENTS

A first example of a packaging box with a pallet according to this invention will be described with reference to FIGS. 3 and 4.

Figure 1:
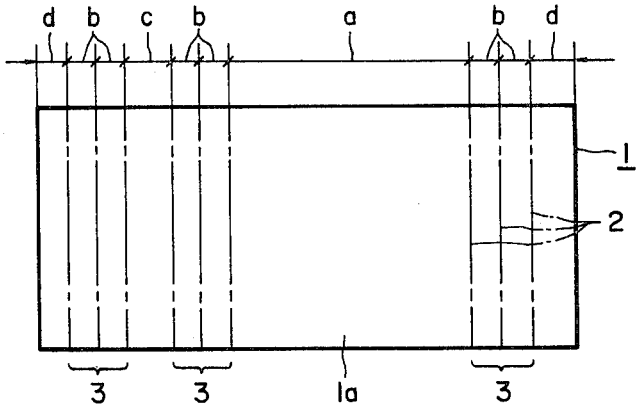
FIG. 1 is an unfolding diagram showing one example of a conventional pallet made of corrutaged fiberboard.
Figure 2:
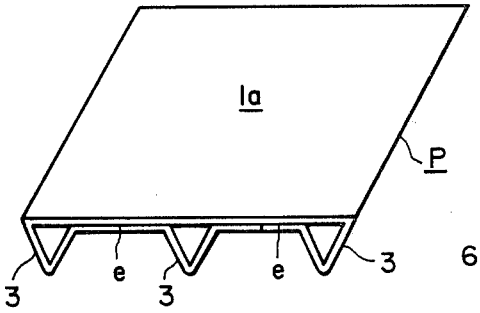
FIG. 2 is a perspective view of the conventional pallet shown in FIG. 1.
Figure 3:
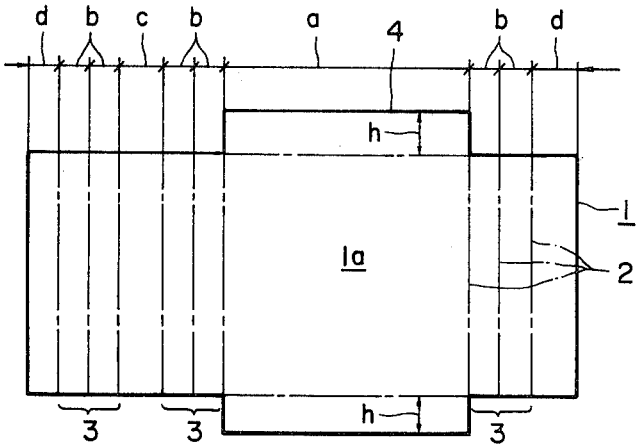
FIGS. 3 and 4 are diagrams showing a first example of a packaging box with a pallet according to this invention; more specifically
Figure 4:
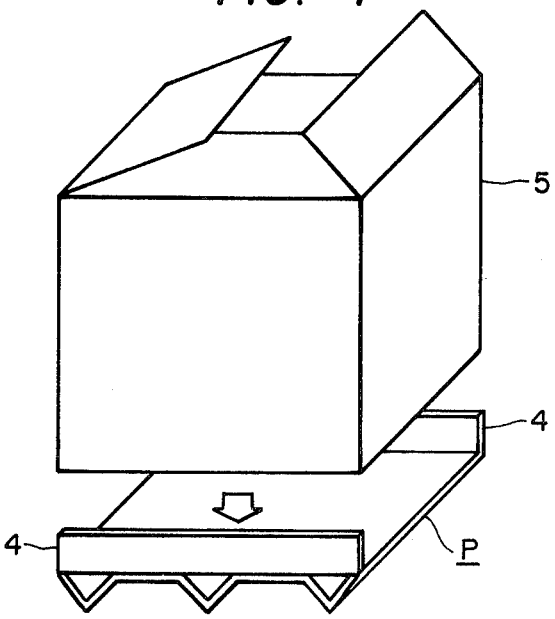

FIG. 3 is an unfolding diagram of a pallet, showing a sheet of rectangular corrugated fiberboard on which, similarly as in FIG. 1, folding lines are formed. FIG. 4 is a perspective view of the packaging box with the pallet, showing how to form the packaging box, utilizing a half-cut corrugated fiberboard box of A-type. In FIGS. 3 and 4, reference characters 1 through 3 and a through d designate parts which are the same as or equivalent to those which have been designated by the same reference characters, respectively, in FIGS. 1 and 2. Further in FIGS. 3 and 4, reference numeral 4 designates end cleats having a width h, which are extended from two opposite edges of the loading surface region 1*a* perpendicularly to the longitudinal axis of the rectangular corrugated fiberboard. The end cleats 4 are bonded to two sides of the half-cut corrugated fiberboard container 5, after the pallet has been formed.

Similarly as in the formation of the pallet shown in FIG. 2, the corrugated fiberboard is folded, and the intermediate spacing region c and the abutting end regions d are bonded to the lower surface of the loading surface region 1*a*. Then, the end cleats 4 are folded towards the upper surface of the loading surface region 1*a*. Thus, the desired pallet has been formed and the corrugated fiberboard container 5 is then placed on the pallet in such a manner that it is between the end cleats 4. Then, the end cleats 4 of the pallet are secured to two sides of the container 5.

Figure 5:
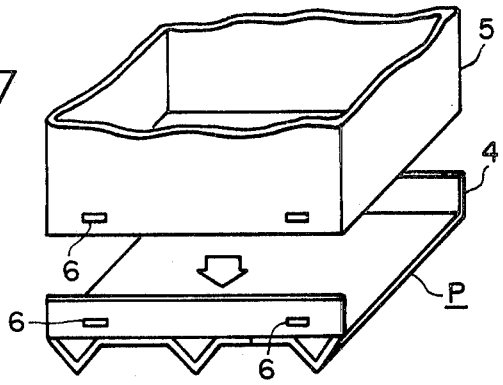
FIGS. 5 and 6 are diagrams showing a second example of the packaging box with the pallet according to the invention; more specifically
Figure 6:
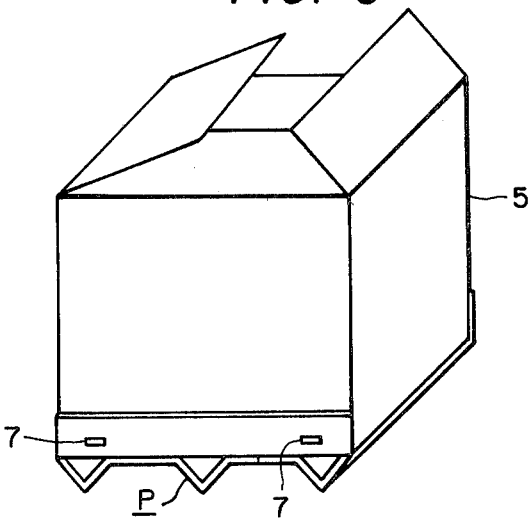

In this case, the following methods may be employed to secure the end cleats 4 to the two sides of the container 5. In one of the methods, the end cleats 4 are secured to the two sides of the container 5 by using adhesives, adhesive tapes, and/or staples, so that the pallet P and the container 5 form one unit. The other method is as shown in FIGS. 5 and 6. At least one through-hole 6 is formed in each end cleat 4 and also in each of the two sides of the container 5 as shown in FIG. 5. Detachable locking pieces 7, which are commercially available, are inserted into the through-holes 6 thus formed, in order to secure the end cleats to the two sides of the container 5. In this case, the container 5 can be installed on or removed from the pallet P respectively by engaging the locking pieces 7 with or disengaging them from the through-holes.

As was described above, the two methods may be employed to secure the pallet to the container. These two methods result in different types of packaging boxes which may be selected according to the purposes of use of the packaging boxes. In the case where it is necessary to use the pallet only, the second method of assembly is preferable since the pallet can be removed from the container by disengaging the locking pieces 7.

Figure 7:
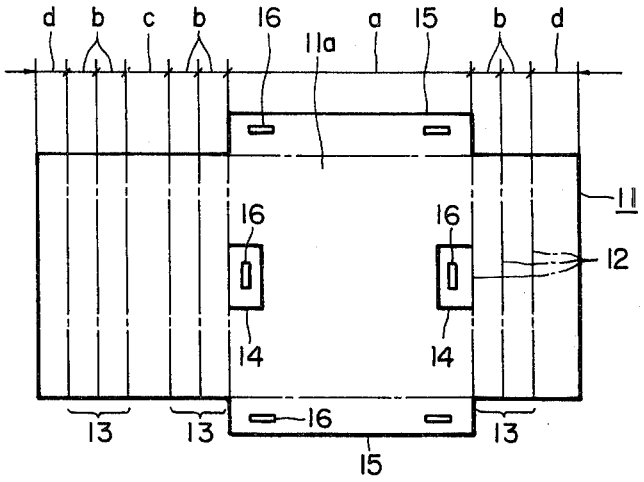
FIGS. 7 through 9 are diagrams showing a third example of the packaging box with the pallet according to the invention; more specifically
Figure 8:
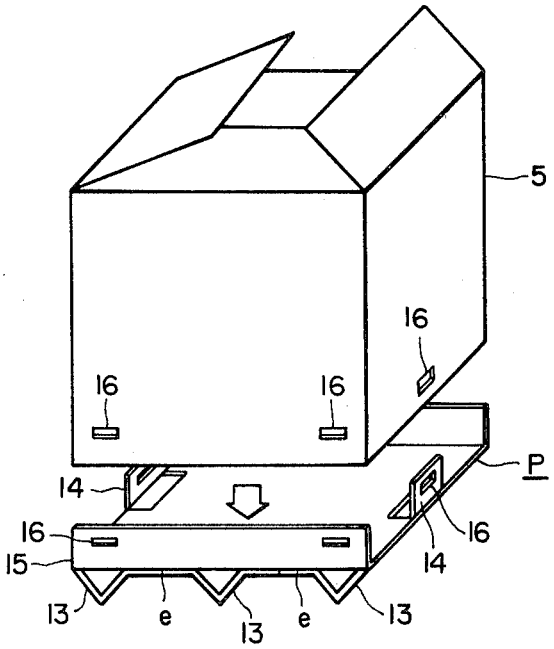
Figure 9:
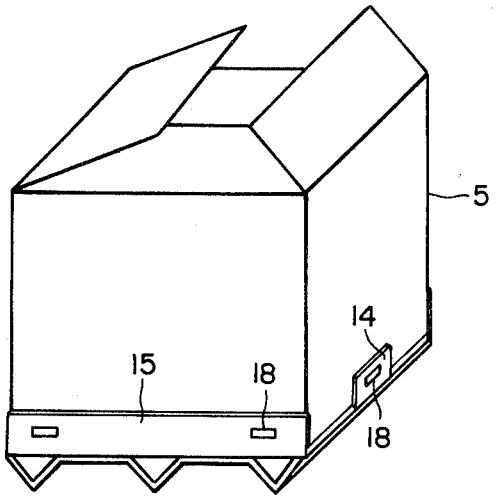

A second example of the packaging box with the pallet is as shown in FIGS. 7 through 9.

In these figures, reference character 11 designates a sheet of substantially rectangular corrugated fiberboard; 11*a* a loading surface region; 12, folding lines; and 13, V-shaped beams.

In FIG. 7, reference character a designates an edge of the loading surface region 11*a*; b, sides forming each triangular beam 13; c, an intermediate spacing region adapted to space adjacent triangular beams 13 from each other; and d, end regions which are abutted against each other in forming the pallet.

Further in FIGS. 7 through 9, reference numerals 14 designate tongue pieces; and 15, end cleats. The tongue pieces 14 are provided along two edges of the loading surface region 11*a*, which are extended across the longitudinal axis of the corrugated fiberboard. Each tongue piece 14 is obtained by forming a U-shaped slot 14*a* along the respective adge of the loading surface region 11*a* and the fiberboard within the slot is folded upwardly along its removing edge. At least one tongue piece 14 is provided along each of the two edges of the loading surface region 11*a*. The end cleats 15 have a width h and are extended from two other edges of the loading surface region 11, which are in parallel with the longitudinal axis of the corrugated fiberboard 11. When a corrugated fiber container 5 (described later) is placed on the pallet which is fabricated by using the corrugated fiberboard 11, the tongue pieces 14 and the end cleats 15 are secured to four sides of the container 5.

At least one through-hole 16 is formed in each of the tongue pieces 14 and the end cleats 15. The aforementioned container 5 is obtained by cutting the bottom of a corrugated fiberboard container and cutting holes 16 around its lower periphery. In the second example, an A-type corrugated fiberboard container is shown; however, it may be a B-type or C-type corrugated fiberboard. In addition, a packaging container made of wood or resin may be employed.

In FIG. 9, reference numeral 18 designates detachable locking pieces which are used to secure the pallet P to the container 5.

The procedure of forming the second example of the packaging box with the pallet will now be described.

The corrugated fiberboard shown in FIG. 7 is folded along the folding lines on both sides of the loading surface region 11*a*, so that the beams 13 are formed at equal intervals on the lower surface of the loading surface region 11*a*. Under this condition, the intermediate spacing region c and the abutting end regions d are bonded to the lower surface of the loading surface region 11*a* with adhesive. In this example, the folding lines 12 are formed on the corrugated fiberboard so that the V-shaped beams are provided at three positions on the lower surface of the loading surface region 11*a* —before folding there are two beams on side of the surface and one beam on the other side so that when the pallet is formed by folding the corrugated fiberboard along the folding lines, two beams are at either end of the lower surface of the loading surface region 11*a* and one beam is at the center. However, the number of beams 13 may be increased according to the size of the loading surface region 11*a*.

The tongue pieces 14 obtained by forming the U-shaped slots in the loading surface region 11*a* are then folded upwardly along the two edges of the loading surface region 11*a*, and similarly the end cleats 15 are folded. An A-type, B-type or C-type corrugated fiberboard container 5 is placed on the pallet in such a manner that the lower end portion of the container 5 is surrounded by the tongue pieces 14 and the end cleats 15 as shown in FIG. 8 and the through-holes 16 cut in the tongue pieces 14 and the end cleats 15 are in alignment with the through-holes 16 cut in the lower end portions of four sides of the container 5, respectively. The detachable locking pieces 18 are fitted in the through-holes 16 as shown in FIG. 9.

In the case when it is necessary to use the pallet only, the pallet can be readily removed from the container 5 by disengaging the locking pieces 18 from the through-holes 16.

The corrugated fiberboard container 5 may be replaced by a bottomless container made of wood or resin. In this case also, through-holes 16 are cut in four sides of the container so that, when the container is set in place on the pallet, the through-holes 16 thus cut are in alignment with the through-holes 16 formed in the tongue pieces 14 and the end cleats 15, respectively. Then, the loacking pieces are fitted in the through-holes. In packaging box with the pallet thus formed, the pallet P and the container 5 are of different materials which is effective in increasing the strength of the container.

In the above-described examples, the box-shaped container is secured to the pallet. However, a sleeve-shaped container (not shown) may also be employed, wherein a pallet with a frame can be formed by securing the sleeve to the pallet.

Figure 10:
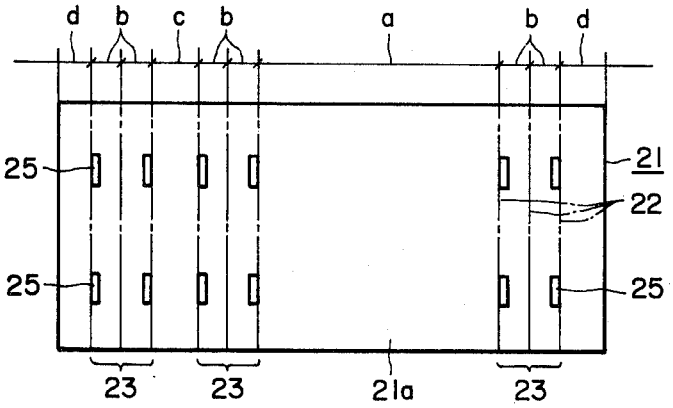
FIGS. 10 and 11 are diagrams showing one improvement of the pallet employed in the invention; more specifically
Figure 11:
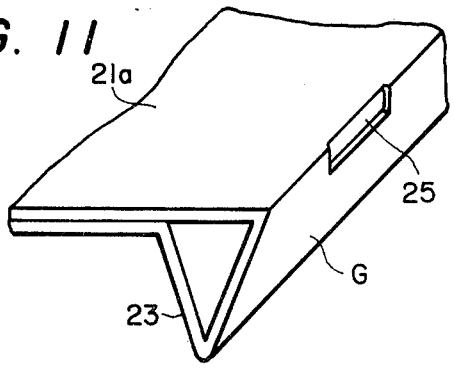

FIGS. 10 and 11 show an improved pallet P in which it is easier to tie the container with strings or bands after articles have been placed in the container.

FIG. 10 shows a sheet of corrugated fiberboard on which folding lines are formed. FIG. 11 is an enlarged perspective view of a part of the pallet, showing an opening which is formed in a triangular beam to receive a tying material. In FIGS. 10 and 11, reference character 21*a* designates a loading surface region; 22, the folding lines; 23, V-shaped beams; a through f, parts which are equivalent to those designated by the same reference characters in FIGS. 1 and 2; and 25, the aforementioned openings.

The openings 25 are formed along the folding lines which will contact the lower surface when the corrugated board 21 is folded to form the triangular beams 23 on the lower surface of the loading surface region 21*a*. Openings 25 are also formed along two folding lines which define two edges of the loading surface region 21*a*, in such a manner that the openings 25 are arranged in at least one substantially straight line. The size of each opening 25 is optional, and the configuration of the opening 25 is also optional, i.e. it may be rectangular or circular. In the case where an object placed on the pallet is to be tied with a tying material such as a string or a band, the tying material is passed through the openings 25 and then tied over the top of the object on the pallet. If it is necessary to tie an object on the pallet with a plurality of tying materials, the openings 25 should be cut to form a plurality of rows.

The openings 25 and the folding lines 22 can be readily formed in a sheet of corrugated fiberboard 21 with a rotary die cutter. When the corrugated fiberboard 21 is folded along the folding lines 22 so that the beams 23 are formed on the lower surface of the loading surface region 21*a*, then the openings 25 for receiving the tying materials are aligned because the openings 25 are cut in the sides b and along the appropriate folding lines 22 as was described above.

While in each of the embodiments the cleats and tongue pieces are shown extending upwardly, it should be easily appreciated that they could be made to extend downwardly with minor modifications.

As is apparent from the above description, the packaging box with the pallet according to this invention, in which the packaging box is separable from the pallet, can be readily obtained by adding the end cleats to the pallet and by combining a bottomless corrugated fiberboard container with the pallet thus modified. The packaging box with the pallet is suitable for articles which should be transported by a fork lift truck after being placed in a corrugated fiberboard container. Furthermore, it is suitable for storing or transporting small articles which are heavy when gathered, or heavy materials or bulky materials. Especially in the case of a heavy articles, the box container 5 can be placed on the pallet after the heavy article has been placed on the pallet, and then the pallet can be secured to the container. Therefore, even a heavy article can be readily packaged. In unpackaging an article, it can be taken out merely by removing the container from the pallet. Thus, the packaging box with the pallet according to the invention can serve as both storage means and transportation means, contributes to the economical use of material, and is low in manufacturing cost.

What is claimed is:

1. A packaging box with a pallet comprising a substantially one-piece rectangular foldable member including a main rectangular panel defining a loading surface region having top and bottom surfaces, two end edges and two side edges, end cleats extending along said two side edges of said loading surface region, a plurality of foldable panels extending parallel to each of said two end edges defining a V-shaped support beam on the bottom surface of said main panel adjacent each end edge and two end panels being bonded to the lower surface of said main panel and said end cleats being disposed perpendicular to the upper surface of said main panel; a bottomless container disposed on said pallet in such a manner that a lower end portion of the container is disposed between said end cleats and means for connecting said lower end portion to said end cleats whereby the upper surface of said main panel forms an interior bottom surface of said container.

2. A packaging box with a pallet as set forth in claim 1 wherein one of said end panels includes a pair of folded panels defining a support beam intermediate said support beams along said end edges and an intermediate spacing panel between two adjacent beams.

3. A packaging box with a pallet as set forth in claim 1 wherein said means for connecting said lower end portion of said container to said end cleats is selected from a group comprising an adhesive, adhesive tape and staples.

4. A packaging box with a pallet as set forth in claim 1 wherein said means for connecting said lower end portion of said container to said end cleats is comprised of a plurality of aligned apertures in the lower end portion of said container and said end cleats and locking means detachably secured in said apertures.

5. A packaging box with a pallet as set forth in claim 1 further comprising two apertured tongue pieces formed from said main panel adjacent said two end edges respectively and disposed perpendicular to said upper surface of said main panel for connection to said lower end portion of said container.

* * * * *